US005395002A

United States Patent [19]

Adler

[11] Patent Number: 5,395,002

[45] Date of Patent: Mar. 7, 1995

[54] COLLAPSIBLE PLASTIC CONTAINER

[76] Inventor: Peter Adler, Avenue de Cedrea 16 BE-1640 Rhode St Genass, Bruxelles, Belgium

[21] Appl. No.: 70,423

[22] PCT Filed: Dec. 4, 1991

[86] PCT No.: PCT/SE91/00825

§ 371 Date: May 17, 1994

§ 102(e) Date: May 17, 1994

[87] PCT Pub. No.: WO92/10406

PCT Pub. Date: Jun. 25, 1992

[30] Foreign Application Priority Data

Dec. 4, 1990 [SE] Sweden ..... 9003850

[51] Int. Cl.[6] ..... B65D 6/24

[52] U.S. Cl. ..... 220/4.28; 220/4.29

[58] Field of Search ..... 220/4.28, 4.29; 217/12, 217/65

[56] References Cited

U.S. PATENT DOCUMENTS 2,659,515 11/1953 Miller ..... 220/4.28
3,700,134 10/1972 Blanchard ..... 217/65
4,181,236 1/1980 Prodel ..... 220/4.29
4,711,361 12/1987 Mischenko ..... 220/4.28
5,056,677 10/1991 Toyosawa ..... 220/4.28

FOREIGN PATENT DOCUMENTS 1159379 12/1983 Canada .
0071467 9/1983 European Pat. Off. .
2166116 4/1986 United Kingdom .

*Primary Examiner*—Joseph Man-Fu Moy
*Attorney, Agent, or Firm*—Merchant & Gould Smith, Edell, Welter & Schmidt

[57] ABSTRACT

A box pallet having a base (1) and four sidewalls (2–5) is characterized in that the base (1) has four vertical walls (7–10) which, together with the upper surface (6) of the base, form an upwardly open, rectangular space for accommodating the sidewalls (2–5), each sidewall being releasably connected to the adjacent sidewall in that the vertical edge portions of the adjacent sidewalls are in the shape of hook-shaped beads (15, 16) engaging one another, and that the upper surface (6) and the vertical walls (7–10) of the base form supporting and guiding means for the sidewalls (2–5) resting loosely on the upper surface of the base.

9 Claims, 6 Drawing Sheets

COLLAPSIBLE PLASTIC CONTAINER

Figure 1:
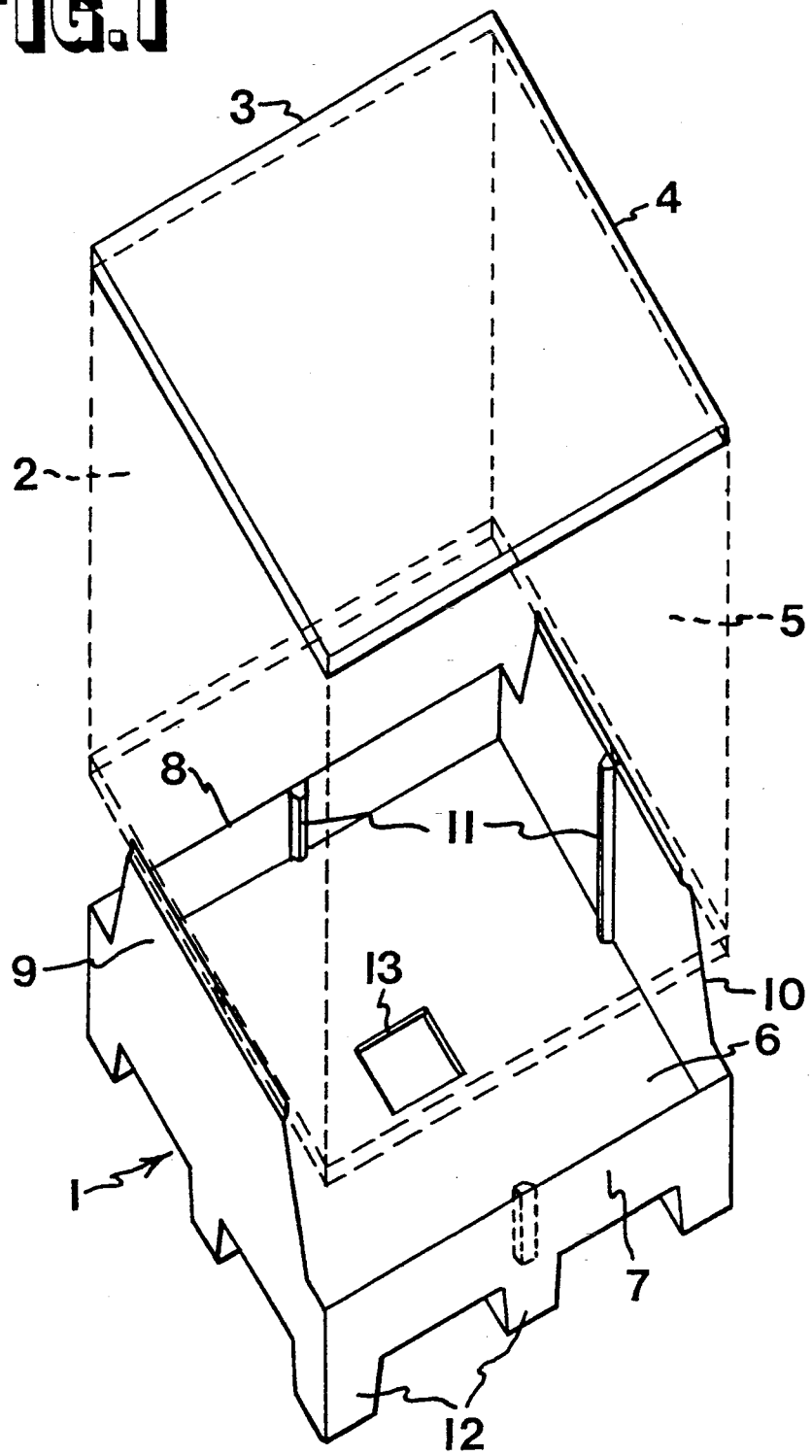

The present invention relates to a box pallet having a base and four side walls. The box pallet is especially designed for transporting and storing plastic raw materials in pellet or powder form, but may also be used for transporting other goods that require a similar transport container.

Plastic raw materials are usually produced in large quantities in pellet or powder form and are transported to the user in bulk, in sacks on loading pallets, or in lid-equipped cylindrical containers of corrugated fibreboard or hardboard (masonite) on loading pallets.

The last-mentioned type of box pallets with cylindrical containers of board or masonite has a volume of about 2 $m^3$ and holds about 1 ton of plastic pellets or plastic powder. Regrettably, the cylindrical container is sensitive to moisture and external damage, and since the box pallet often is exposed to wind and weather and fairly rough treatment when transported, the container will quite frequently break, causing the plastic raw material to leak out. These prior-art box pallets with cylindrical containers of board or masonite are, in addition, bulky and unwieldy when empty. As a result, only the loading pallet proper, and not the cylindrical container, is returned when the box pallet has been emptied. The fact that currently-used box pallets are only reused to a small extent involves considerable inconveniences, both from the economic and the environmental point of view, since the empty containers accumulate at the user's end. Another drawback is that today's box pallets with cylindrical containers of masonite do not make full use of the square loading area of the pallet.

It should here be mentioned that GB 2,166,116 discloses a box pallet which consists of a square base and four side walls which are interconnected by L-shaped vertical side edge portions which can be pushed into one another. The side walls are fixed to the base by means of a number of downwardly-directed legs equipped with projecting teeth which snap into corresponding holes in the base when the side walls are pressed down towards the base. Once the side walls have been fastened to the base, it is very difficult to release them again. Owing to their rather intricate design, the side walls are expensive to manufacture and can only be made in one size.

EP 0,285,953 discloses a container which consists of a pallet base with four vertical side walls which are interconnected by a hinge mechanism with a rod-shaped male member and arc-shaped female members which permit the side walls to be folded up. The side walls are fixed to the base with special steel clips. Although the pallet construction is collapsible, it is nevertheless disadvantageous in that the intricate design of the side walls does not permit the making of side walls of varying height, e.g. by extrusion. The fact that the side walls are fixed to the base by loose steel clips further complicates the construction and increases the number of component parts.

The object of the present invention is to reduce or eliminate the inconveniences of prior-art box pallets, especially those of the above box pallet with a cylindrical container of masonite, and to provide an improved box pallet which is simple and inexpensive to manufacture, easily assembled and disassembled, as well as handily and expediently returned for reuse.

According to the invention, this and other objects are achieved by a box pallet which has a base and four side walls and which is characterised in that the base has four vertical walls which, together with the upper surface of said base, form an upwardly open, rectangular space for accommodating the side walls, each side wall being releasably connected to the adjacent side wall in that the vertical edge portions of the adjacent side walls are in the shape of hook-shaped beads engaging one another and enabling the interconnection of the vertical edge portions of aligned and abutting side walls by turning one side wall through 90°; and that the upper surface and the vertical walls of said base constitute supporting and guiding means for the side walls resting loosely on the upper side of said base.

Further distinctive features of the invention are recited in the appended subclaims, and also appear from the following description.

Figure 2:
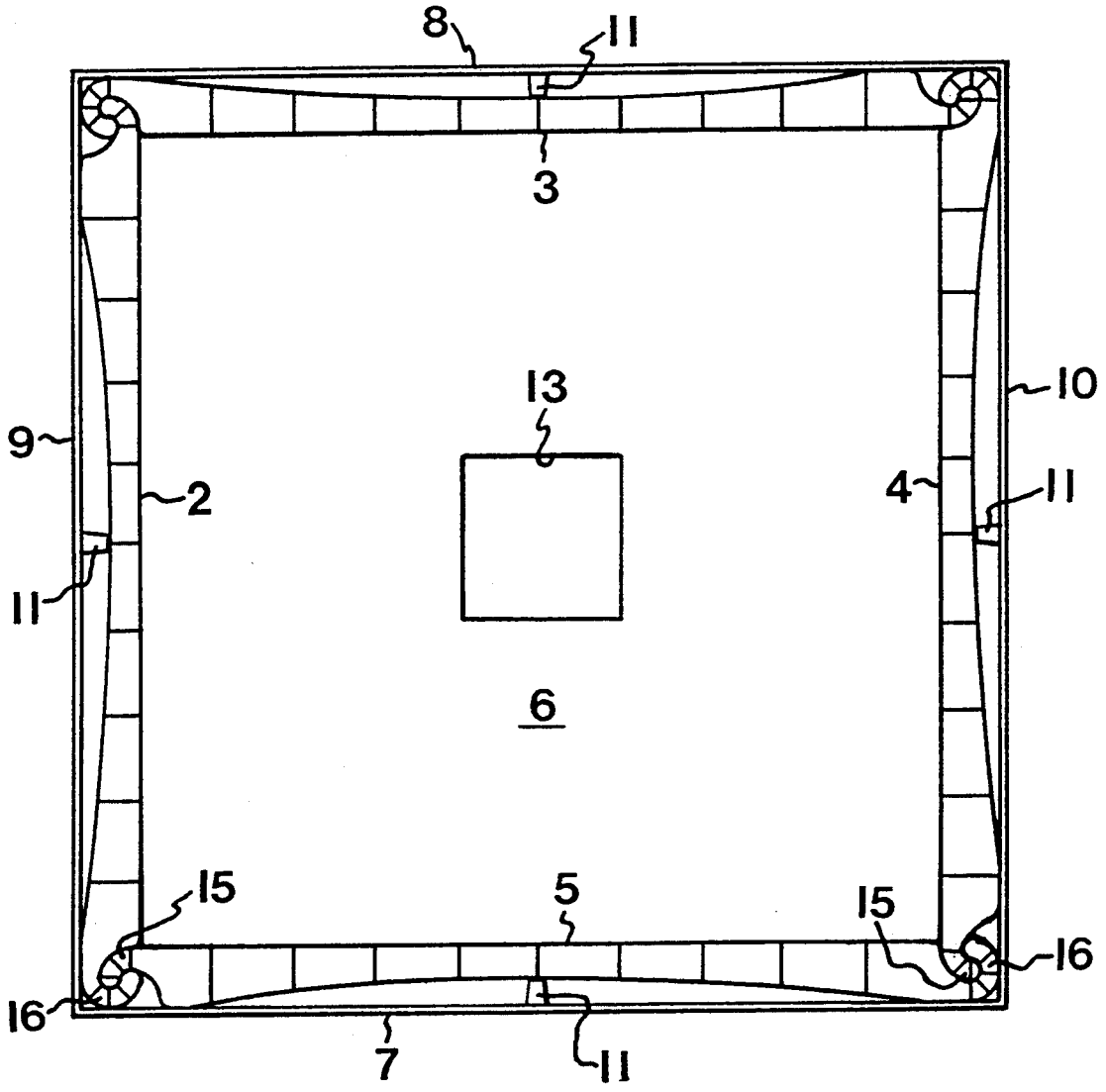
Figure 4:
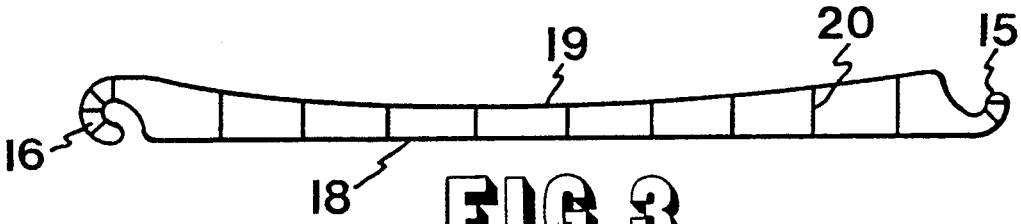
Figure 3:
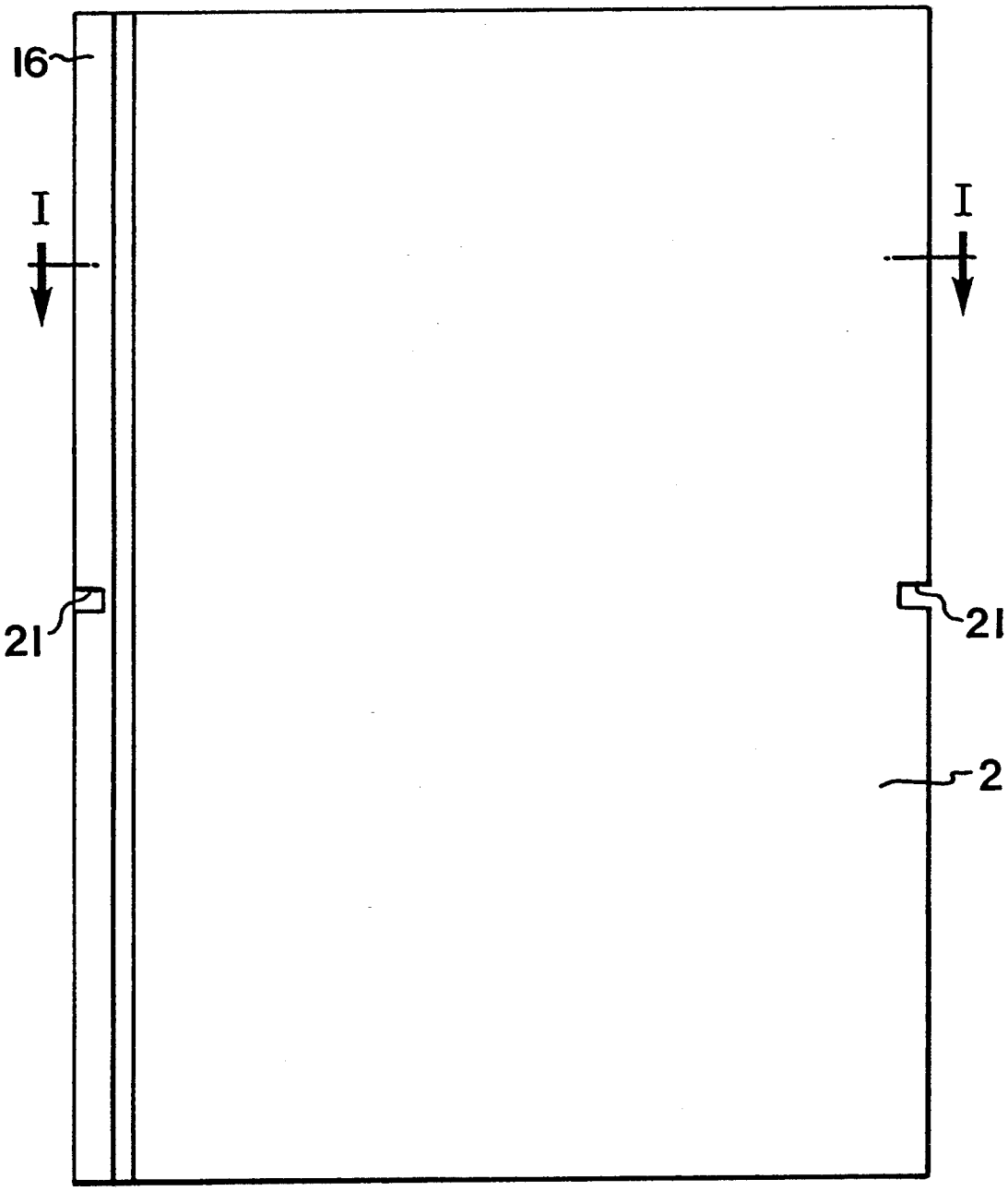
Figure 5:
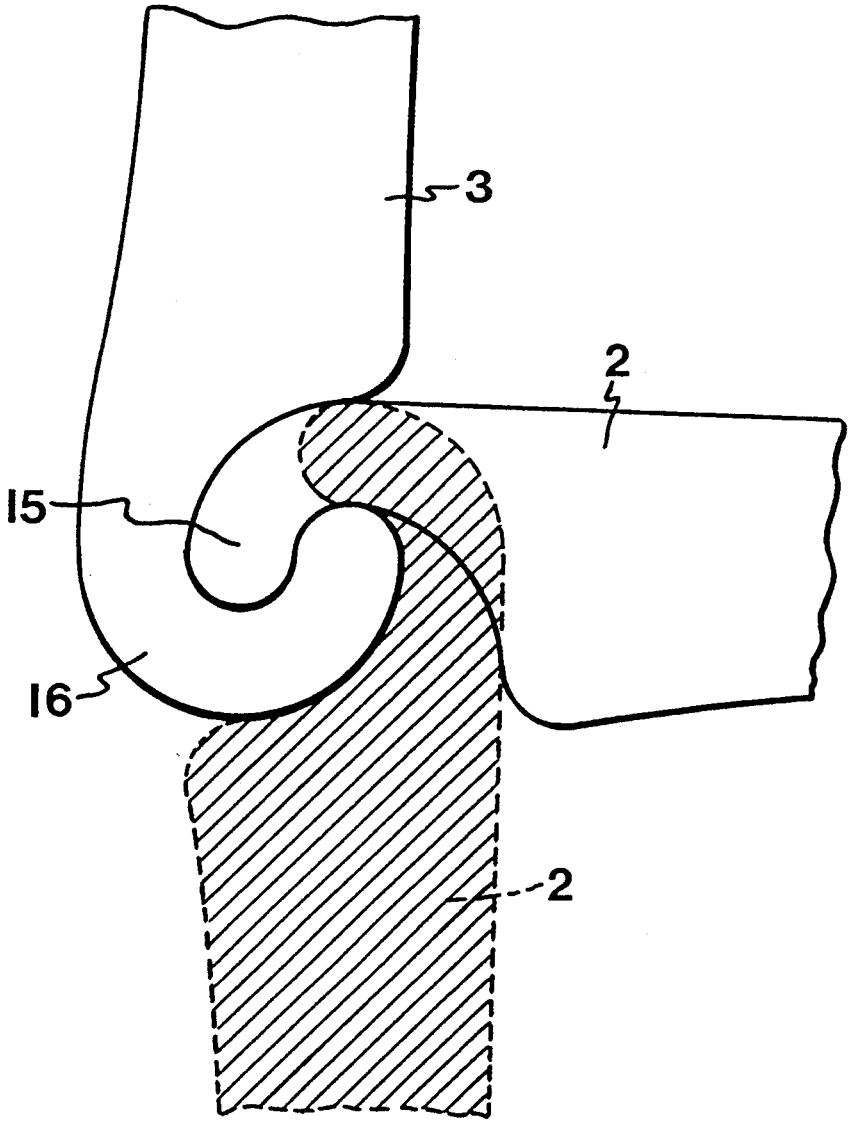
Figure 6:
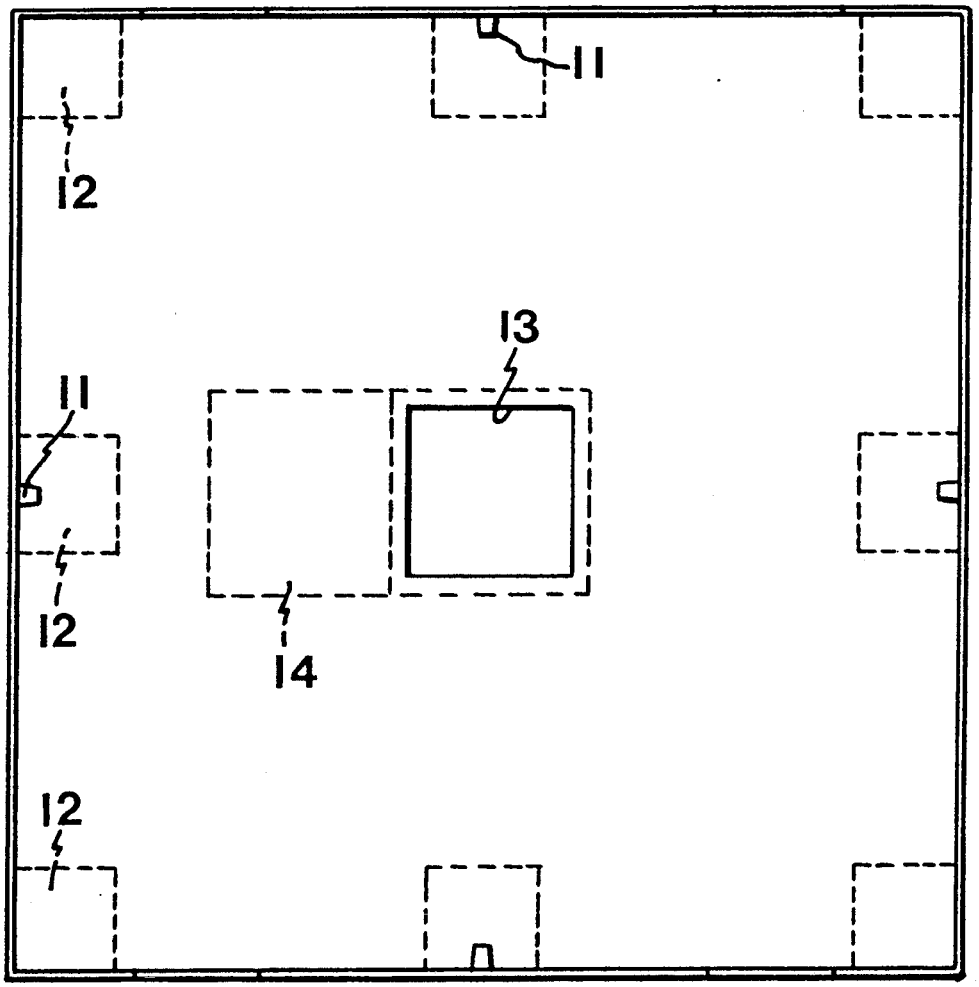
Figure 7:
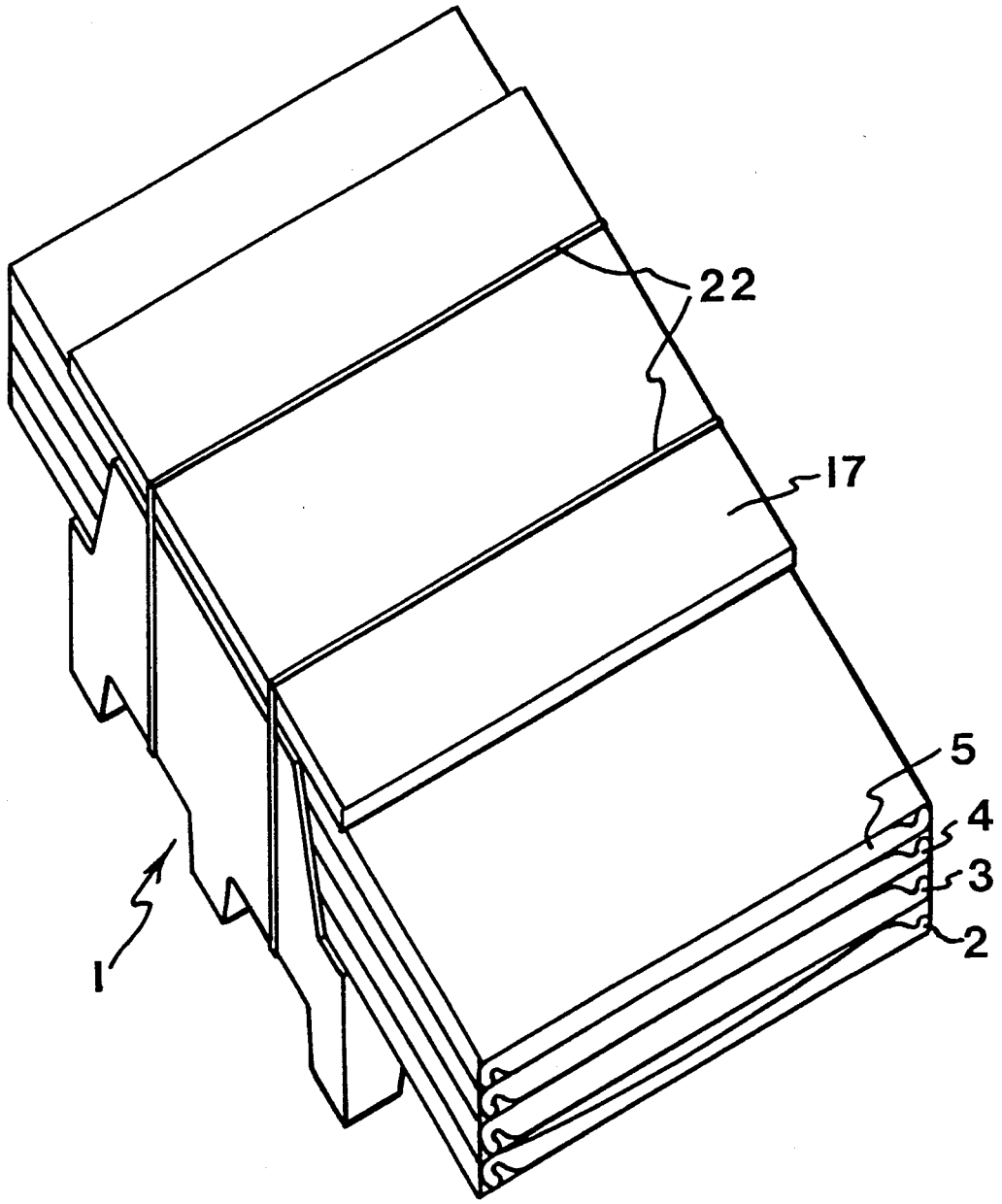

The invention will be described in more detail below with reference to preferred embodiments and the accompanying drawings, in which FIG. 1 is a schematic perspective view of a box pallet according to the invention, the side walls being removed from the base and indicated by dashed lines for reasons of clarity, FIG. 2 is a top view of the box pallet in FIG. 1, FIG. 3 is a side view of a side wall, FIG. 4 is a section of the side wall in FIG. 3 taken along the line I—I, FIG. 5 is an enlarged detail view of the interconnectable, hook-shaped beads of two side walls, FIG. 6 is a top view of a pallet base, and FIG. 7 is a schematic perspective view of a box pallet which has been disassembled to be returned.

In the drawings, like elements have been given like reference numbers.

As appears from FIG. 1, the box pallet according to the invention consists of a base 1 and four side walls 2, 3, 4 and 5. The base 1, preferably made of injection-moulded plastic, such as polypropylene, has a substantially flat upper side 6 which in circumference is defined by four vertical walls 7, 8. 9 and 10. The two opposing walls 9 and 10 are higher than the two opposing walls 7 and 8 for reasons to be explained below. Further, each wall preferably has a vertical lath 11 on the inside of the wall, suitably approximately in the middle of the wall. As illustrated in FIG. 1, as well as in FIG. 6, the base has eight supporting legs 12, of which four are provided in the corners of the base, and four are provided in the middle of the side edges of the base. Between the supporting legs, there are thus formed spaces where the forks of a lifting and transporting device, such as a fork truck, can be introduced.

In a preferred embodiment of the invention, the base is formed with an opening 13 which conveniently can be closed. In the embodiment illustrated in FIG. 6, the opening can be closed by a sliding door 14 arranged on the underside of the base and shown, in FIG. 6, in retracted (open) position.

The side walls 2, 3, 4 and 5 of the box pallet and their mode of interconnection are illustrated in more detail in FIGS. 2–5. Preferably, all the side walls are identical and interchangeable. Thus, each side wall is substantially rectangular, and the vertical edge portions of the erected side wall are in the shape of roundedly hook-shaped beads 15, 16. As appears from the drawings, the beads 15, 16 are slightly differently designed, the hook-shaped bead 15 being smaller and more open than the markedly hook-shaped bead 16. As can be seen more clearly in FIG. 5, this design of the beads 15, 16 enables the connection of the vertical edge portions of aligned and abutting side walls 2, 3 by turning one side wall 2 through 90°. In FIG. 5, The side wall 2 is indicated by dashed lines and hatched lines in its original position before being connected, the side wall 2 being aligned with and applied against The side wall 3. The outer surface of the hook 16 on the side wall 3 is then applied against the correspondingly curved inner surface of the hook 15 on the side wall 2. By turning the side wall 2 anticlockwise through 90°, the hook 15 is introduced into the hook 16 and applied against the inner surface thereof. When the side wall 2 has been turned through 90°, it is locked against further turning by applying the tip of the hook 15 against the bottom of the inside of the hook 16 and by applying the rounded outside of the hook 15 against the correspondingly curved inside of the hook 16. Three of the four side walls can be interconnected by this operation. The fourth side wall is connected and locked to the other three by introducing its hooks 15 and 16 into the grooves formed by the hooks 16 and 15, respectively, of the free edge portions of the other side walls. It is also possible to interconnect the side walls by pushing all the side walls into one another, instead of interconnecting three of the side walls by turning one side wall through 90°.

Thus, the side walls 2–5 are rapidly and expediently interconnected and disengaged in the manner described above.

When the four side walls 2–5 have been interconnected, they form a rectangle, more specifically a square if they are of the same width. Then, the four interconnected side walls are mounted on the base 1 by being pushed down inwardly of the vertical walls 7–10 of the base. When mounted, the side walls 2–5 are supported by the base 1, as well as supported and guided by the side walls 7–10 of the base. Then, a sack containing plastic raw material in pellet or powder form is placed in the upwardly open, rectangular space formed by the side walls and the base. Finally, the box pallet is suitably provided with a lid 17 (FIG. 7) which is applied against the upper edges of the side walls 2–5.

Owing to the longitudinally uniform cross-section of the side walls 2–5, shown in FIG. 4, the side walls are advantageously manufactured by extrusion of a plastic material, such as polypropylene. By extruding the side walls, their length can be varied as required, i.e. the side walls can easily be made shorter or longer without any unnecessary complications or additional expense.

As is also apparent from FIGS. 2 and 4, the side walls 2–5 are preferably double-walled, having a flat inner wall 18 and an outwardly concave outer wall 19, the inner wall 18 and the outer wall 19 being interconnected by reinforcing laths 20. The concave shape of the outer wall 19 gives the side wall a much higher resistance to outwardly-directed forces, i.e. the side wall is able to better withstand internal pressure caused by the plastic raw material contained in the box pallet.

To further increase the resistance of the side walls to internal pressure and to support the concave outer surfaces 19 of the side walls, vertical laths 11 are preferably provided in the middle of the inside of the vertical side walls 7–10 of the base. Preferably, laths are also provided on the inside of the lid 17 of the box pallet.

In the preferred embodiment, when the user receives the box pallet containing plastic raw material from the producer, the door 14 in the base 1 is moved aside to expose the opening 13, and the sack containing the plastic raw material is torn with a pointed object inserted through the opening 13 to allow the plastic raw material to be discharged through the opening 13.

The empty box pallet can be disassembled to be returned to the manufacturer by disengaging the side walls by reversing the assembly procedure, whereupon they are stacked on the base 1, as shown in FIG. 7, between the two opposing higher walls 9 and 10 of the base. Suitably, the height of the walls 9 and 10 substantially corresponds to that of the piled side walls 2–5. To maintain the piled side walls securely in place and prevent any sliding action, the side walls are preferably formed with a recess 21 in the middle of each side edge. The recesses 21 are intended to engage the laths 11 of the side walls 9 and 10 when the side walls are piled on the base. After the side walls have been stacked on the base, the lid 17 is placed over the side walls. Finally, the entire unit is suitably secured by two clamps 22, as shown in FIG. 7. The box pallet can then be returned to the producer and reused. To facilitate and simplify reuse, the box pallet is conveniently made of plastic, preferably polyolefine plastic, especially ethylene plastic or propylene plastic.

Should one or more of the component parts of the box pallet be damaged when the pallet is used, the damaged part, or the entire box pallet, if so desired, can be ground and extruded or injection moulded into a new box pallet.

It will be appreciated that the box pallet described above is highly advantageous compared with prior-art box pallets in that it is easy to make and assemble, as well as resistant to rough treatment. Further, the box pallet according to the invention provides easy accessibility to the plastic raw material in the pallet and is easy to disassemble and reuse.

Although an especially preferred embodiment of the box pallet according to the invention has been described above and illustrated in the drawings, it goes without saying that the design of the box pallet may be modified within the scope of the appended claims.

I claim:

1. Box pallet having a base (1) and four side walls (2–5), characterised in that the base (1) has four vertical walls (7–10) which, together with the upper surface (6) of said base, form an upwardly open, rectangular space for accommodating the side walls (2–5), each side wall being releasably connected to the adjacent side wall in that the vertical edge portions of the adjacent side walls are in the shape of hook-shaped beads (15, 16) engaging one another and enabling the interconnection of the vertical edge portions of aligned and abutting side walls (2, 3) by turning one side wall (2) through 90°; and that the upper surface (6) and the vertical walls (7–10) of said base constitute supporting and guiding means for the side walls (2–5) resting loosely on the upper side of said base.

2. Box pallet as claimed in claim 1, characterised in that one pair of opposing walls (9, 10) of the four vertical walls (7–10) of said base are higher than the other pair of opposing walls (7, 8), and that the two higher walls form lateral boundary and supporting means for the side walls (2–5) when these have been disengaged from one another and stacked on the base (1) between the two higher vertical walls (9, 10).

3. Box pallet as claimed in claim 2, characterised in that the two higher vertical walls (9, 10) of said base each are provided with a vertical lath (11) designed to engage a corresponding recess (21) in the vertical side edge of the side walls when these walls are stacked on said base (1).

4. Box pallet as claimed in claim 3, characterised in that the horizontal cross-section of the side walls is planoconcave, the concave surface (19) facing outwards.

5. Box pallet as claimed in claim 4, characterised in that the side walls (2–5) are double-walled, and that the outer walls (18, 19) of the side walls are connected to vertical reinforcing laths (20).

6. Box pallet as claimed in claim 5, characterised in that the side walls (2–5) are made of extruded plastic.

7. Box pallet as claimed in claim 6, characterised in that the base (1) and its vertical walls (7–10), as well as the side walls (2–5), are made of plastic.

8. Box pallet as claimed in claim 7, characterised in that the base has a closeable opening (13) for discharging goods loaded on said base.

9. Box pallet as claimed in claim 8, characterised in that the underside of said base has eight supporting legs (12), one in each corner and one in the middle of each side edge.

* * * * *